US005490299A

United States Patent [19]

Dinsmoor, III et al.

[11] Patent Number: 5,490,299

[45] Date of Patent: Feb. 13, 1996

[54] SEATING SYSTEM WITH PRESSURE RELIEVING FLUID PAD

[75] Inventors: John C. Dinsmoor, III, Westminster; Barry VanEveren, Loveland, both of Colo.

[73] Assignee: Jay Medical Ltd., Boulder, Colo.

[21] Appl. No.: 316,732

[22] Filed: Oct. 3, 1994

Related U.S. Application Data

[60] Continuation-in-part of Ser. No. 217,366, Mar. 24, 1994, which is a division of Ser. No. 945,733, Sep. 16, 1992, Pat. No. 5,352,023.

[51] Int. Cl.[6] ..... A47C 27/18; A47C 7/02

[52] U.S. Cl. ..... 5/654; 297/452.41

[58] Field of Search ..... 5/654, 653, 909; 297/452.41, DIG. 3, 452.26, 284.6

[56] References Cited

U.S. PATENT DOCUMENTS

| | | | |
|---|---|---|---|
| 4,726,624 | 2/1988 | Jay | 5/654 |
| 5,201,780 | 4/1993 | Dinsmoor, III et al. | 5/654 |
| 5,352,023 | 10/1994 | Jay et al. | 5/654 |
| 5,378,045 | 1/1995 | Siekman et al. | 5/654 |
| 5,390,384 | 2/1995 | Dinsmoor, III et al. | 5/654 |
| 5,395,162 | 3/1995 | Jay et al. | 5/654 |

*Primary Examiner*—Alexander Grosz
*Attorney, Agent, or Firm*—Flehr, Hohbach, Test, Albritton & Herbert

[57] ABSTRACT

A seating system primarily intended for use in wheelchairs and similar applications for reducing the development of decubitus ulcers. The seating system includes a relatively rigid, shaped tray and a pressure relieving fluid pad. The tray has a thigh supporting shelf and a depressed seating well. The fluid pad preferably has a plurality of fluid pouches positionable over the thigh supporting shelf of the tray and an array of rearward pouches positionable over the depressed seating well. The rearward pouches in the seating well are wedge shaped and taper downwardly in vertical thickness from one end portion to the other. Each rearward pouch has its thicker end portion overlying a central part of the seating well and its thinner end portion positioned over the upwardly inclined, outer rim section of the seating well. In this manner, the resulting arrangement of the rearward pouches concentrates the bulk of the fluid toward the center or middle of the seating well to substantially prevent any undesirable bottoming out of the user's ischial tuberosities and coccyx on the rigid tray.

43 Claims, 5 Drawing Sheets

SEATING SYSTEM WITH PRESSURE RELIEVING FLUID PAD

RELATED APPLICATIONS

This application is a continuation-in-part of U.S. patent application Ser. No. 217,366 filed Mar. 24, 1994 which is a division of U.S. patent application Ser. No. 945,733 filed Sep. 16 1992, now U.S. Pat. No. 5,352,023.

BACKGROUND OF THE INVENTION

1. Field of the Invention

This invention relates to the field of seating systems and more particularly, to the field of anti-decubitus seating systems for wheelchairs for reducing the development of pressure sores.

2. Discussion of the Background

As set forth in the prior invention of U.S. Pat. No. 5,352,023, growing children present a unique problem to seating and back systems for wheelchairs in that the fitting requirements of the child are continually changing sometimes on a month-to-month basis. The basic objective of such pediatric seating and positioning systems is to maintain the pelvic and spinal alignments to a desired configuration so that normal growth may occur without risk of permanent physical deformity. Children are more prone to skeletal deformities because their bones are soft and are very susceptible to being pulled into permanent deformities, particularly during growth spurts. The previous invention of U.S. Pat. No. 5,352,023 disclosed a seat and back structure that was essentially adjustable in numerous aspects so that the positioning requirements of the growing user could be continually met throughout a period of growth. The present invention is directed to further improving the capabilities of the seating system by substantially improving the pressure relieving qualities of the fluid bladder or pad component of the previous invention of U.S. Pat. No. 5,352,023.

Research has shown that most pediatric wheelchair bound users are not substantially at risk for decubitus ulcers (pressure sores, bed sores). This is true primarily because the diagnoses do not involve the loss of sensation in the lower extermities as would for example spinal cord injuries. However, there are some instances where the diseases (e.g., cerebral palsy and spina-bifida) have progressed to the point where sensation is impaired and the user requires a seating system that not only maintains the appropriate pelvic alignment but also provides a quality of pressure and shear relief to the underlying soft tissue of the user. In the past, most of the fluid—filled, pressure-relieving bladder configurations have employed oversized fluid segments or pouches that are bunched or gathered into a defined seating well. The excess bladder material serves a dual purpose in that it prevents hammocking of the bladder membranes or covers and also provides the necessary stroke or displacement tangentially to the fluid support surface so that shear forces on the supported body are kept at a minimum. The prior use of these types of fluid bladders has proven to be very successful when applied to cushion bases or trays where the user's position on the cushion is predictable (i.e., hips to the back and centered). Furthermore, in these prior applications, it was assumed that the majority of the fluid pad would be in contact with the user and thus the need to restrain certain portions of the bladder from ballooning or billowing around the user was not required. The ballooning or billowing described is detrimental to the function of the fluid pad because the supporting fluid volume would then be allowed to accumulate in these ballooning volumes. This would cause the user to sink farther into the cushion and eventually bottom out on the underlying rigid foam tray of the cushion structure.

The adjustable growth cushion described in the previous invention of U.S. Pat. No. 5,352,023 inherently creates a condition where there are unsupported or unused portions of the fluid pad. This previous invention employed a fluid pad that was segmented into several pouches on each side of the cushion centerline. This segmenting prevents the detrimental fluid migration from underneath the user if the user is indeed sitting on only the front half of the cushion surface. This configuration is an appropriate solution for when the fluid bladder is required to provide only a limited amount of pressure relief and little or no shear relief. Improved pressure and shear relief may be achieved in this prior invention by introducing more fluid to the seating well area. However, simply oversizing the fluid bladder of this previous invention relative to the underlying tray structure would not be a particularly effective solution because the unsupported areas of the fluid pad would accumulate fluid volume and allow the user to bottom out.

The fluid bladder or pad of the present invention overcomes the problems discussed above. Among other things, it does so by oversizing the top or canopy portion of the outer covers of the fluid pouches in a vertical direction normal to the tray support surface. Furthermore, the fluid pad of the present invention cooperates with the underlying foam tray by the incorporation of three-dimensional, geometrically configured fluid pouches that correspond to the general contours of the depressed seating well of the underlying tray. The resulting configuration is thus capable of satisfying all of the requirements of pressure relief, shear relief, and growth accommodation.

SUMMARY OF THE INVENTION

This invention involves a seating system primarily intended for use in wheelchairs and similar applications for reducing the development of decubitus ulcers. The seating system includes a relatively rigid, shaped tray and a pressure relieving fluid pad. The tray has a thigh supporting shelf and a depressed seating well. The fluid pad preferably has a plurality of fluid pouches positionable over the thigh supporting shelf of the tray and an array of rearward pouches positionable over the depressed seating well. The rearward pouches in the seating well are wedge shaped and taper downwardly in vertical thickness from one end portion to the other. Each rearward pouch has its thicker end portion overlying a central part of the seating well and its thinner end portion positioned over the upwardly inclined, outer rim section of the seating well. In this manner, the resulting arrangement of the rearward pouches concentrates the bulk of the fluid toward the center or middle of the seating well to substantially prevent any undesirable bottoming out of the user's ischial tuberosities and coccyx on the rigid tray. Additionally, the top or canopy portions of each of the pouches is substantially oversized to significantly reduce the possibility of undesirable hammocking and development of shear forces on the user.

DETAILED DESCRIPTION OF THE PREFERRED EMBODIMENTS

Figure 1:
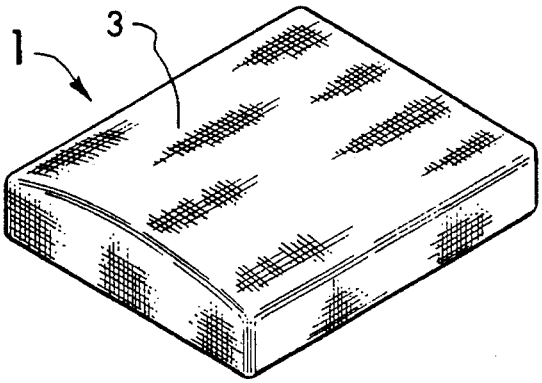
FIG. 1 is a view of the covered seating system of the present invention.
Figure 2:
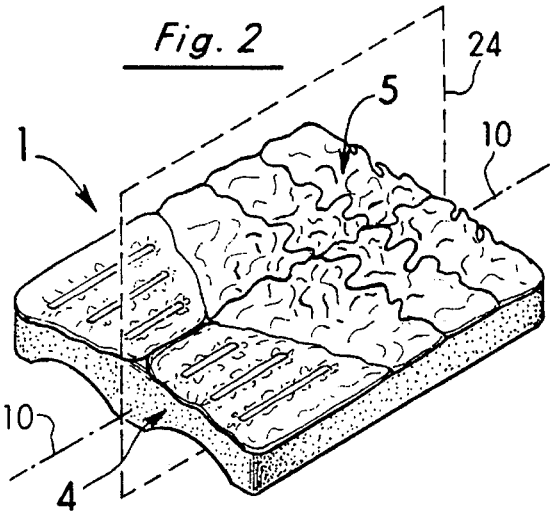
FIG. 2 is a view of the seating system of FIG. 1 with the cover removed to show the underlying tray and the fluid pad which is positioned on it.
Figure 3:
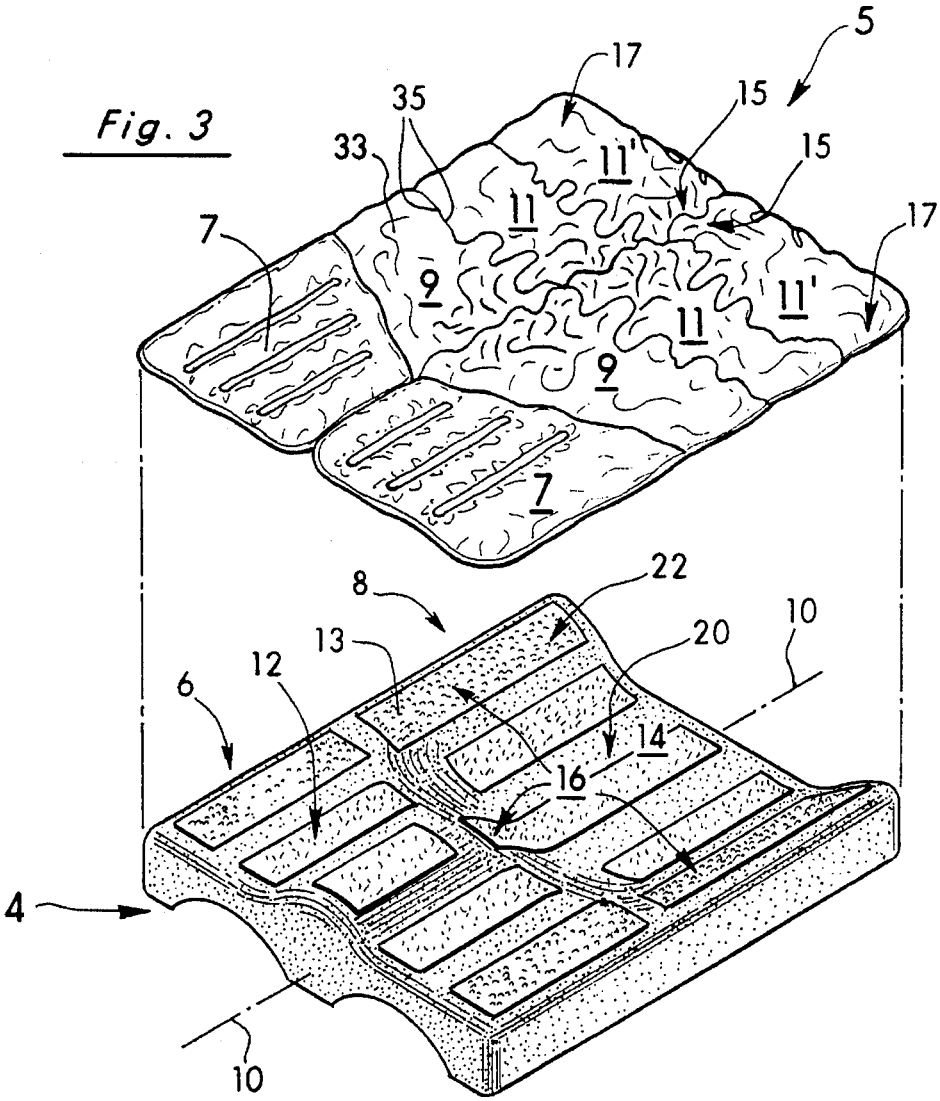
FIG. 3 is an exploded view of the tray and fluid pad.

The seating system 1 of the present invention as best seen in FIGS. 1–3 includes an outer cover 3 (see FIG. 1) positioned over a base or tray 4 and fluid pad 5 (see FIG. 2).

Figure 4:
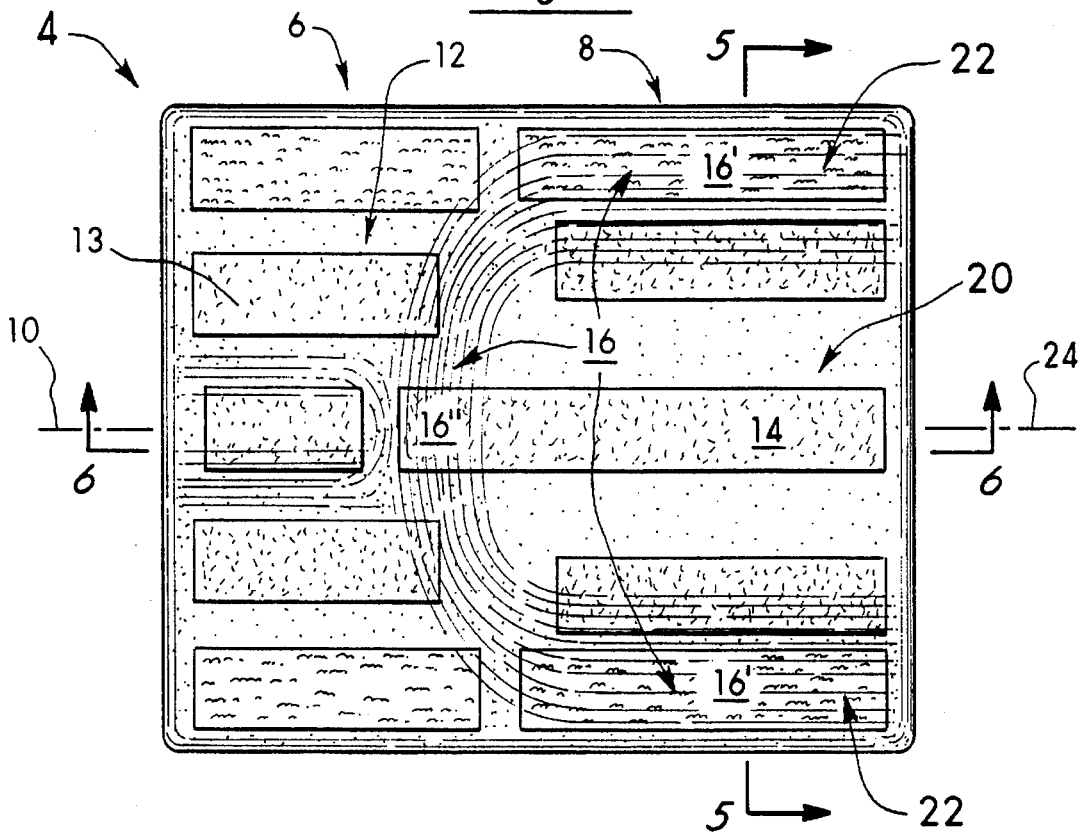
FIG. 4 is a top plan view of the tray of FIG. 3.
Figure 5:
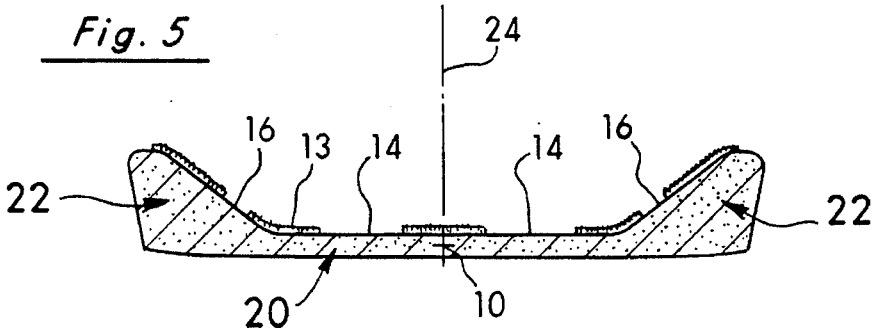
FIG. 5 is a cross-section view of the tray taken along line 5—5 of FIG. 4.

The base member or tray 4 is preferably made of polyethylene or other relatively rigid material and has forward and rearward sections 6 and 8 adjacent one another along the central axis 10 (see FIGS. 3 and 4). The forward section 6 has an upper surface 12 which forms a shelf to receive and support the user's thighs (see FIG. 14). The rearward section 8, in turn, has a depressed seating well with an upper surface 14, 16 to receive and support the user's buttocks including the user's ischial tuberosities 18 (see FIGS. 14 and 15). The seating well includes a bottom section 20 and U-shaped rim section 22 (see FIGS. 3 and 4). The upper surface 14 of the bottom section 20 extends substantially horizontally and outwardly (see FIG. 5) on each side of a central vertical plane 24 containing the central axis 10. Surface 14 as shown is dimensioned to support at least the ischial tuberosities 18 of the user's buttocks (see again FIG. 15). Referring back to FIG. 5, the upper surface 16 of the rim section 22 extends upwardly from the upper surface 14 of the bottom section 20 substantially at an inclined angle thereto (e.g., 45 degrees).

Figure 6:
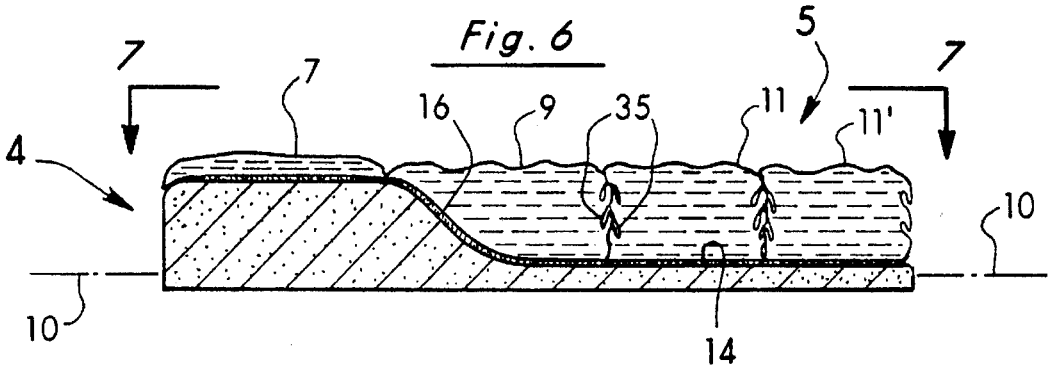
FIG. 6 is a cross-sectional view of the tray taken along line 6—6 of FIG. 4 with the fluid pad of the present invention shown positioned on it.
Figure 7:
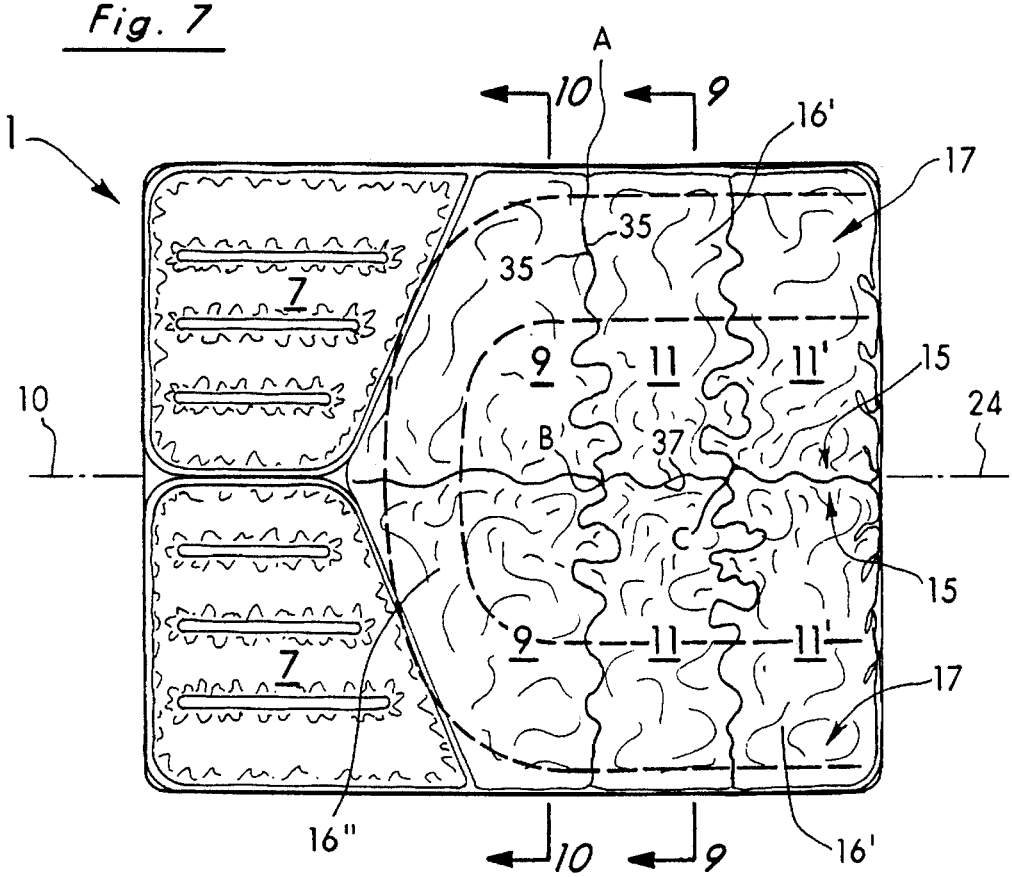
FIG. 7 is a top plan view taken along line 7—7 of FIG. 6.

The fluid pad 5 of the preferred embodiment as illustrated in FIGS. 3, 6, and 7 includes forward pouches 7 and rearward pouches 9, 11, and 11'. Forward pouches 7 are substantially filled with a fluid and intended to be positioned over the thigh supporting shelf or surface 12 of the rigid tray 4 (see FIG. 14). The rearward pouches 9, 11, and 11' in turn are similarly filled with a fluid and intended to be positioned over the upper surface 14, 16 of the seating well of the tray 4 (see FIGS. 14 and 15).

Figure 8:
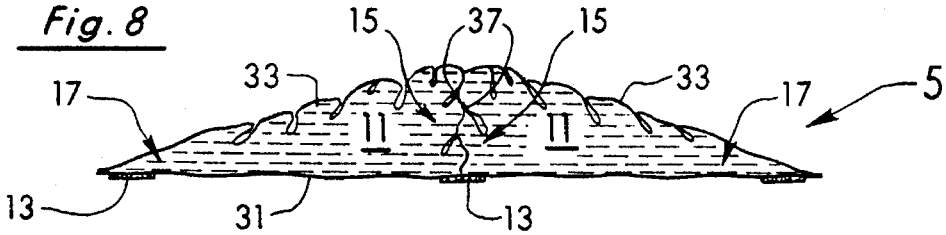
FIG. 8 is a cross-sectional view of the fluid pad by itself lying on a flat surface.
Figure 9:
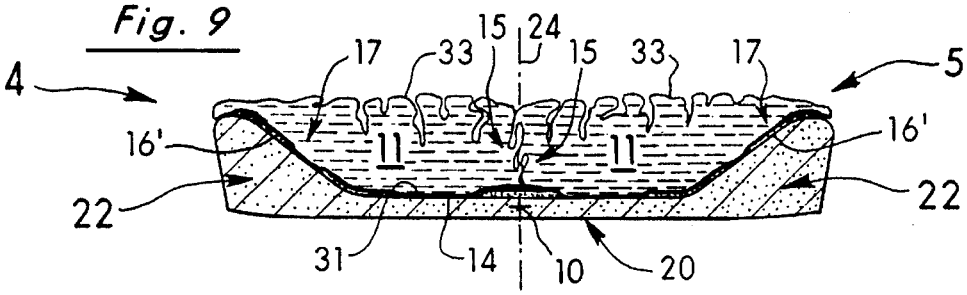
FIG. 9 is a cross-sectional view taken along line 9—9 of FIG. 7 showing the fluid pad positioned on the contoured tray.

The rearward pouches 11 and 11' are of substantially the same design. As best seen in FIG. 8 (which is a cross-sectional view of pouches 11 of the pad 5 with the pad 5 simply lying on a flat surface), each of the rearward pouches 11 is substantially wedge-shaped in cross section with the wedge shape tapering down in vertical thickness from the centrally positioned end portion 15 to the outer end portion 17. In use, each wedge-shaped pouch 11 as shown in FIG. 9 is positioned (e.g., by hook-loop fasteners 13 or simply by its own weight) in the seating well of tray 4 with the thicker, first end portion 15 of each pouch 11 adjacent the central vertical plane 24 containing the central axis 10 of the tray 4. Additionally, as shown in FIG. 9, each thicker, first end portion 15 of each wedge-shaped pouch 11 overlies a central part of the upper surface 14 of the bottom section 20 of the seating well. The thinner, second end portion 17 of each wedge-shaped pouch 11 is then positioned to overlie an outward part of the inclined upper surface 16 of the rim section 22 of the seating well. In this manner as illustrated in FIG. 9, the resulting arrangement concentrates the bulk of the fluid toward the center or middle of the seating well above the supporting surface 14. The fluid thickness adjacent the central vertical plane 24 and above the surface 14 is then much greater than is prior arrangements and will substantially prevent any undesirable bottoming out of the user's ischial tuberosities 18 and coccyx 26 on the rigid tray 4. Further, this is accomplished in an efficient and cost saving manner as the wedge shape of pouches 11 (as well as 11' and 9) enables the maximum fluid thickness to be achieved above the seating well surface 14 with a minimum use of the relatively heavy and costly fluid and with a minimum of undesirable ballooning of the pouches 11 at the outer end portions 17.

The most rearward pouches 11' as discussed above are also wedge-shaped or chisel-shaped like pouches 11. These rearward pouches 11 and 11' as illustrated primarily support the ischial tuberosities 18 and coccyx 26 of the user's buttocks (see FIGS. 14 and 15). The remaining rearward pouches 9 in turn primarily support the forward fleshy part of the user's buttocks. The inclusion of two sets of pouches 11 and 11' helps to prevent rearward ballooning and also enables the seating system to accommodate a growing child or adult who is losing or gaining weight or otherwise changing shape. That is, with a growing child, his or her buttocks can be initially positioned with the ischial tuberosities and coccyx primarily over pouches 11 with the wheelchair back essentially over the seam between the pouches 11 and 11'. Then, as the child grows, the wheelchair back and seating system can be adjusted relative to each other wherein both sets of pouches 11 and 11' are used to support the growing child's ischial tuberosities 18 and coccyx 26 more in the fashion of FIG. 14.

Figure 10:
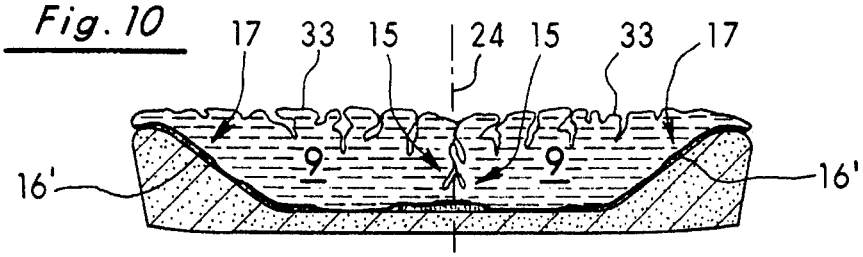
FIG. 10 is a cross-sectional view taken along line 10—10 of FIG. 7.

As illustrated in FIG. 10, the rearward pouches 9 like pouches 11 and 11' are wedge-shaped in a vertical plane (i.e., cut 10—10 from FIG. 7) which is substantially perpendicular to the central plane 24. Additionally, as best seen in FIG. 6, the rearward pouches 9 are also wedge-shaped in a vertical plane (i.e., cut 6—6 from FIG. 4) which is substantially parallel to the central vertical plane 24. In this manner, each pouch 9 assumes substantially a pie shape (see FIG. 12) versus the chisel-shape of pouches 11 and 11'. Referring again to FIG. 12 and as also shown in conjunction with the bottom plan view of FIG. 11, the pouches 7, 9, 11, and 11' of the fluid pad 5 can be separate pouches individually attached or positioned over the tray 4 (FIG. 12) or can be assembled together into a unitary piece (FIG. 11).

Figure 11:
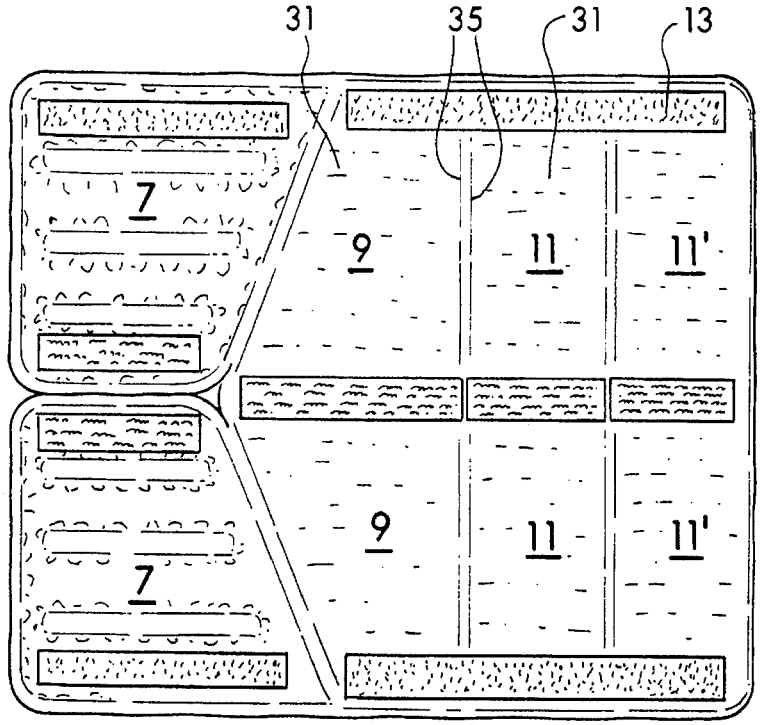
FIG. 11 is a bottom plan view of the fluid pad of FIG. 7.
Figure 12:
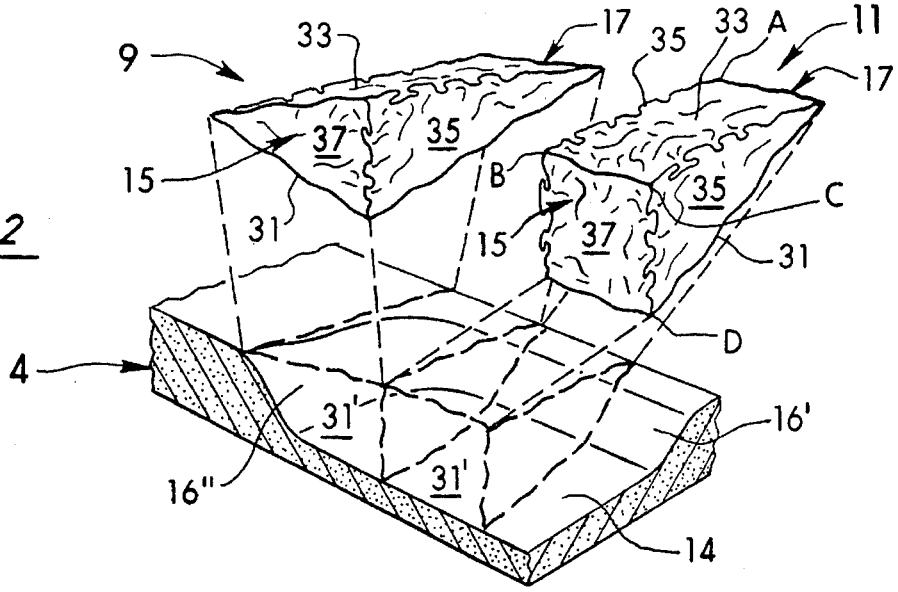
FIG. 12 is an exploded view of two of the wedge-shaped fluid pouches of the present invention.
Figure 13:
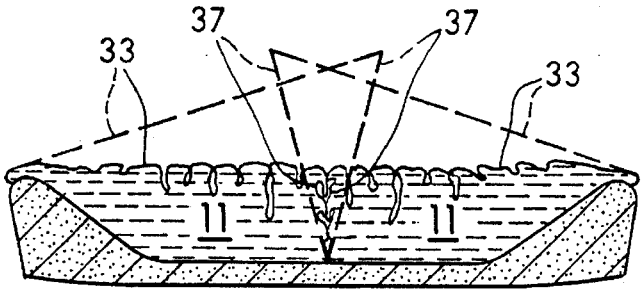
FIG. 13 illustrates another design of the fluid pads to create the desired oversizing to prevent hammocking and shear forces.
Figure 14:
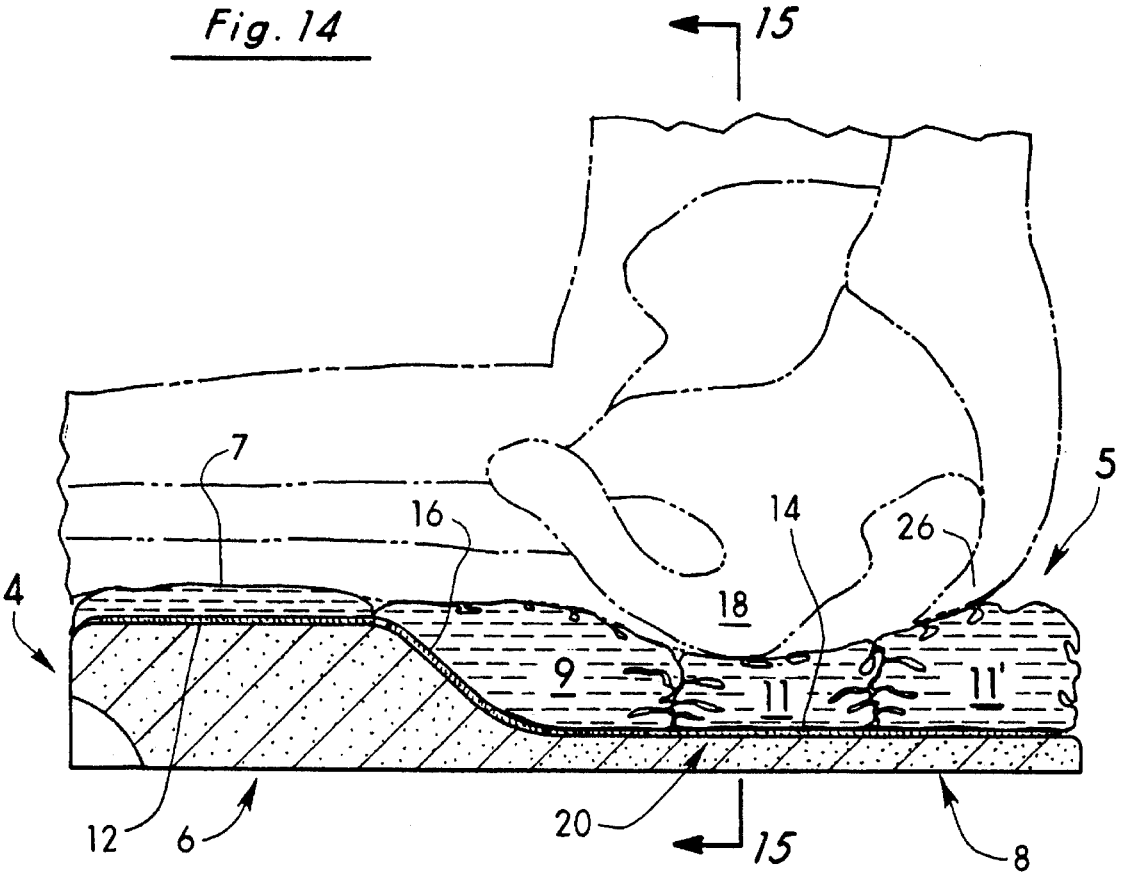
FIG. 14 is a side cross-sectional view taken along line 14—14 of FIG. 15 showing the seating system of the present invention in use to support the user's thighs and buttocks.
Figure 15:
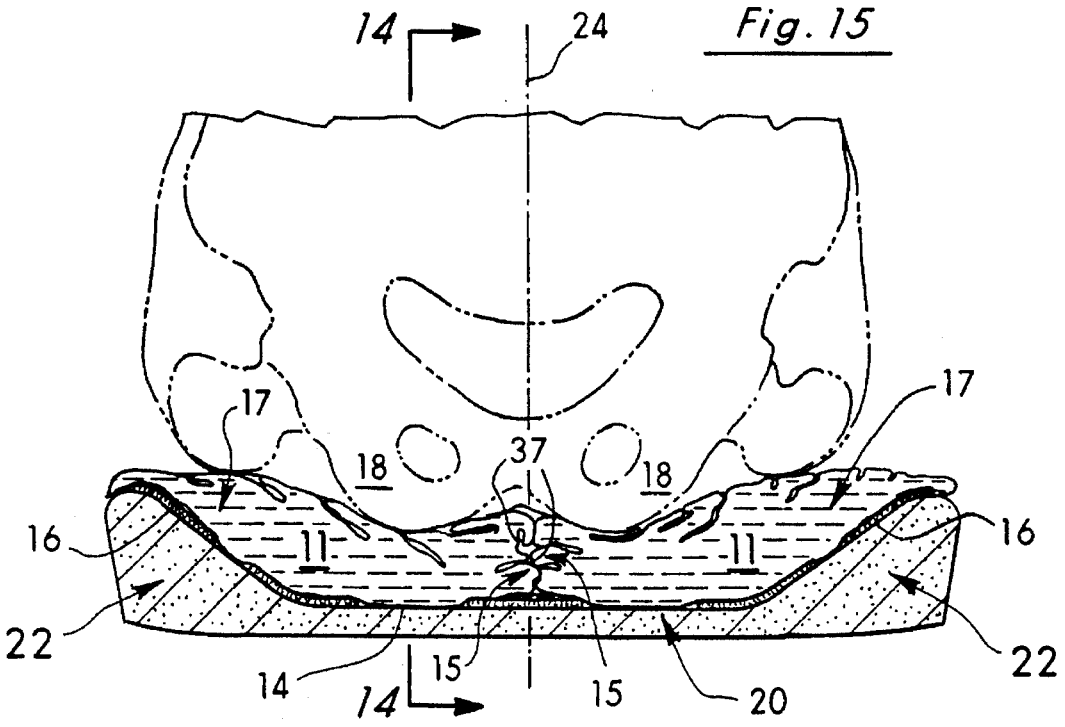
FIG. 15 is a cross-sectional view taken along line 15—15 of FIG. 14.

Also, as best seen in these FIGS. 11 and 12 as well as FIGS. 14 and 15, each rearward pouch 9, 11, and 11' is oversized to prevent hammocking of the fluid pad 5 in use. That is, each pouch has a cover containing the fluid wherein the cover has a bottom portion 31 and an upper or canopy portion 33, 35, 37. The cover is made of flexible material (e.g., polyurethane film) and is partially filled (e.g. 40%–70%) with fluid. Each cover of the preferred embodiment is substantially oversized so that in use, the upper or canopy portion 33, 35 37 of each pouch (see FIG. 9 for example) has considerable slack in it. The upper cover portion can then be allowed to wrinkle and fold back on itself where the cover portion at 33 faces upwardly to receive and support the user. Additionally, the canopy portion can wrinkle and fold back on itself and adjacent pouch cover portions where the tops 33, sides 35, and ends or bases 37 of the adjacent cover portions abut or overlap one another. In this manner and in use, the upper cover portion 33, 35, 37 will preferably not be drawn taut like a hammock nor create undesirable shear forces on the user. The lower cover portion or base 31 of each of the rearward pouches 9, 11, and 11' can also be oversized if desired. However, in the preferred embodiments of FIGS. 11 and 12, the area of the base 31 of each of the rearward pouches 9, 11, and 11' is substantially the same as the area 31' of the parts (see FIG. 12) of the upper surface 14, 16 of the seating well they overlie. This desired oversizing of the upper cover portion 33, 35, 37 can be achieved in any number of ways. For example, as shown in dotted lines in FIG. 13, the full shape of each pouch has been exaggerated or extended beyond a simple right triangular shape. In use as shown in solid lines in FIG. 13, this provides even more surface area to the upper or canopy portion 33, 35, 37 for increased slack to further minimize the possibility of any hammocking or shearing occurring.

The oversizing and degree of resulting slack, wrinkles, and fold backs in the preferred embodiment are also directionally controlled in three dimensions. For example, it is preferred that more slack and oversizing in pouches 9, 11, and 11' be in a lateral direction across or perpendicular to the central plane 24 than in or along the central plane 24. Further, it is also preferred that the vertical oversizing of the cover ends or bases 37 be greater than the lateral oversizing. As perhaps best seen in FIG. 7, such oversizing of pouch 11 in the lateral direction perpendicular to central plane 24 (as measured by comparing the linear distance between points A and B with the actual distance along the convolutions of side 35 between points A and B) is about 1:1.5 or 150%. Similarly, the oversizing from points B to C is about 1:1.25 or 125%. The vertical oversizing of pouch 11 between points C and D (see FIG. 12) is then about 1:1.5–3.0 or 150% to 300% (e.g., 2 inches:3–6 inches). Stated another way, the slack in the vertical or C–D direction of the base portion 37 (as measured by comparing the convoluted distance to the linear distance) is much greater than the A–B slack in the top portion 33. Similarly, the A–B slack in the top portion 33 is greater than the B–C slack in the base portion 37.

Among other things, this directionally controlled oversizing in three dimensions allows for an increased production of total oversizing and slack laterally across the seating system. This is where such oversizing and resulting slack are most needed to reduce the possibility of hammocking and of the development of shear forces. In this regard, the vertical oversizing of the ends or bases 37 is particularly helpful. More specifically, before any hammocking will develop, the top of the base 37 essentially at B–C of pouch 11 in FIG. 12 will be drawn by the weight of the user outwardly of the central vertical plane 24 (see FIG. 15). In this manner, even more slack and upwardly facing surface area will be made available in the fluid pad 5 for supporting the user before any undesirable hammocking or shearing can occur. The controlled, three-dimensional oversizing of the pouches in combination with the wedge shape of the pouches also results in producing more slack and desirable wrinkling and folding back of the pouch canopy 33, 35, 37 the nearer one is to the central plane 24. It also significantly reduces any ballooning or billowing of the pouches at their outer end portions 17. These desirable results are primarily a result of the wedge shape itself. However, they are enhanced by the controlled, three-dimensional oversizing discussed above. In this manner, the oversizing and slack are greater and concentrated or more prevalent away from the apex at 17 of the wedge shape and toward the central plane 24 and bases 37 of the wedge-shaped pouches where such slack and oversizing are most needed. Additionally, any ballooning or billowing of the thinner, outer end portions 17 is greatly reduced.

Each pouch 7, 9, 11, and 11' is sealed and isolated from the other pouches to prevent any fluid communication between them. In this manner, the pouches can then be individually filled as desired. The fluid in the pouches 7, 9, 11, and 11' is preferably incompressible with a viscosity of at least one (i.e., water) and more preferably is a highly viscous liquid such as disclosed in U.S. Pat. No. 4,588,229. Such preferred liquids exhibit non-resilient, non-restoring properties typical of plastic or viscous thixotropic materials which flow gradually when pressure is applied to them but which maintain their shape and position in the absence of pressure. However, other highly viscous fluid such as gels, oil, or grease can also be used.

In use as best seen in FIGS. 6–7 and 9–10, the rearward pouches 9, 11, and 11' of the fluid pad 5 are positioned over the upper surface 14, 16 of the seating well. In doing so, each set of two pouches 9, 11, and 11' is positioned on opposite sides of the central vertical plane 24 with their respective thicker, end portions 15 abutting. These thicker, end portions 15 are respectively positioned to preferably overlie different parts of the upper surface 14 of the seating well. Similarly, the thinner, end portions 17 are preferably positioned to overlie different parts of the inclined upper surface 16 of the rim section 22 of the seating well.

The rim portion 22 and its upper surface 16 as illustrated in FIGS. 4 and 7 are U-shaped wherein the thinner or second end portions 17 of the respective pouches 9, 11, and 11' overlie different segments of the U-shape of the rim portion 22. In this regard, for example, the outer end portions 17 of pouches 11' overlie leg segments 16' of the U-shape (see FIG. 7) on opposite sides of the central vertical plane 24. Similarly, the outer end portion 17 of pouch 11 (at the top in the orientation of FIG. 7) overlies a segment on the leg 16' of the U-shape. This segment is then spaced about the U-shape from the segment in the connecting base 16" of the U-shape overlain by the pouch 9 (on the lower left in the orientation of FIG. 7). Nevertheless, and although the thinner, outer portions 17 of these catercorner pouches 11 and 9 are spaced from each other about the U-shape, their end portions 15 still abut one another at the corners at B. Adjacent pouches about the U-shape also preferably abut one another along the sides 35 of each pouch. For example, as best seen in FIGS. 7 and 12, adjacent pouches 9 and 11 (on the top side of vertical plane 24 in the orientation of FIG. 7) have their sides 35 abutting.

While several embodiments of the present invention have been shown and described in detail, it is to be understood that various changes and modifications could be made without departing from the scope of the invention.

We claim:

1. A seating system primarily intended for use to relieve pressure and to reduce development of decubitus ulcers, said seating system including:

a relatively rigid, shaped tray extending along a central axis and having a depressed seating well with an upper surface intended to support the user's buttocks including the user's ischial tuberosities, said seating well having a bottom section and a rim section, each of said bottom and rim sections having an upper surface together forming at least part of the upper surface of said seating well wherein the upper surface of said bottom section extends substantially horizontally and outwardly on each side of a central vertical plane containing said central axis of said tray and wherein the upper surface of said rim section extends upwardly from the upper surface of said bottom section substantially at an inclined angle thereto, said upper surface of said bottom section being dimensioned to support at least the ischial tuberosities of the user's buttocks, and a fluid pad having at least a first pouch substantially filled with fluid having a viscosity of at least one, said pouch being substantially wedge-shaped in cross section with said wedge shape tapering down in vertical thickness from a thicker first end portion to a thinner second end portion, said wedge-shaped pouch being positioned in said seating well with the thicker first end portion of said wedge-shaped pouch substantially adjacent said central vertical plane containing the central axis of said substantially rigid tray and overlying at least a part of the upper surface of the bottom section of the seating well and with the thinner second end portion of said wedge-shaped pouch overlying at least a part of the inclined upper surface of the rim section of said seating well.

2. The seating system of claim 1 wherein said fluid pad further includes at least a second pouch substantially filled with a fluid having a viscosity of at least one, said second pouch being substantially wedge-shaped in cross section with said wedge shape tapering down in vertical thickness from a thicker first end portion to a thinner second end portion, said wedge-shaped second pouch being positioned in said seating well with the thicker first end portion thereof substantially adjacent said central vertical plane containing the central axis of said substantially rigid tray and overlying at least another part of the upper surface of the bottom section of said seating well and with the thinner second end portion overlying at least another part of the inclined upper surface of the rim section of said seating well.

3. The seating system of claim 2 wherein the respective first end portions of the wedge-shaped first and second pouches abut one another.

4. The seating system of claim 2 wherein said rim section is substantially U-shaped.

5. The seating system of claim 4 wherein said parts of the inclined upper surface of the U-shaped rim section overlain by the second end portions of said wedge-shaped pouches include different segments of the U-shape.

6. The seating system of claim 5 wherein said different segments of said U-shaped rim section are spaced from each other about said U-shape.

7. The seating system of claim 6 wherein the respective first end portions of said wedge-shaped first and second pouches abut one another.

8. The seating system of claim 6 wherein said different segments of said U-shape are on opposite sides of the central vertical plane containing the central axis of said substantially rigid tray.

9. The seating system of claim 6 wherein said different segments of said U-shape are on the same side of the central vertical plane containing the central axis of said substantially rigid tray.

10. The seating system of claim 6 wherein one of the segments of said U-shaped rim section is part of a leg of said U-shape and the other segment is part of the connecting base of the U-shape.

11. The seating system of claim 6 wherein one of the segments of said U-shaped rim section is part of a leg of said U-shape and the other segment is part of the other leg of said U-shape.

12. The seating system of claim 6 wherein said fluid pad includes at least a third pouch positioned between and respectively abutting said first and second pouches.

13. The seating system of claim 5 wherein said different segments of said U-shaped rim section are adjacent one another about said U-shape.

14. The seating system of claim 13 wherein the respective first end portions of said wedge-shaped first and second pouches abut one another.

15. The seating system of claim 13 wherein said different segments of said U-shape are on opposite sides of the central vertical plane containing the central axis of said substantially rigid tray.

16. The seating system of claim 15 wherein said different segments of said U-shape are on the same side of the central vertical plane containing the central axis of said substantially rigid tray.

17. The seating system of claim 13 wherein each of said first and second pouches has a respective side portion extending between the first and second end portions of each respective first and second pouch wherein said first and second pouches are positioned with the respective side portions thereof abutting one another.

18. The seating system of claim 13 wherein one of the segments of said U-shaped rim section is part of a leg of said U-shape and the other segment is part of the connecting base of the U-shape.

19. The seating system of claim 13 wherein one of the segments of said U-shaped rim section is part of a leg of said U-shape and the other segment is part of the connecting base of the U-shape.

20. The seating system of claim 2 wherein the cross section of said first pouch is wedge-shaped in a vertical plane substantially perpendicular to the central vertical plane containing the central axis of said tray.

21. The seating system of claim 20 wherein the cross-section of said second pouch is wedge-shaped in a vertical plane substantially perpendicular to the central vertical plane containing the central axis of said tray.

22. The seating system of claim 21 wherein said second pouch is additionally wedge-shaped in a cross section in a vertical plane substantially parallel to the central vertical plane containing the central axis of said tray.

23. The seating system of claim 22 wherein said second pouch is substantially pie shaped.

24. The seating system of claim 2 wherein each of said wedge-shaped first and second pouches is oversized to substantially prevent hammocking of the fluid pad in use.

25. The seating system of claim 24 wherein said first pouch has an outer cover containing said fluid therein, said outer cover having a base overlying said parts of the upper surfaces of said bottom and rim sections of the seating well wherein the remainder of said outer cover is oversized and slack to prevent hammocking.

26. The seating system of claim 25 wherein the base has an area substantially the same as the area of the upper surfaces of said bottom and rim sections overlain thereby wherein said oversizing to prevent hammocking is substantially in the remainder of said outer cover.

27. The seating system of claim 1 wherein said first pouch has an outer cover containing said fluid therein, said outer cover having a base overlying said parts of the upper surfaces of said bottom and rim sections of the seating well wherein the remainder of said outer cover is oversized and slack with portions thereof folding back on one another to prevent hammocking.

28. The seating system of claim 27 wherein the base has an area substantially the same as the area of the upper surfaces of said bottom and rim sections overlain thereby wherein said oversizing to prevent hammocking is substantially in the remainder of said outer cover.

29. The seating system of claim 1 wherein said cross section of said first pouch is wedge-shaped in a vertical plane substantially perpendicular to the central vertical plane containing the central axis of said tray.

30. The seating system of claim 1 wherein said cross section of said first pouch is wedge-shaped in a vertical plane substantially parallel to the central vertical plane containing the central axis of said tray.

31. The seating system of claim 30 wherein said first pouch is additionally wedge-shaped in a cross section in a vertical plane substantially perpendicular to the central vertical plane containing the central axis of said tray.

32. The seating system of claim 31 wherein said first pouch is substantially pie shaped.

33. The seating system of claim 1 wherein said tray further includes a thigh supporting shelf and said fluid pad further includes at least a second pouch positioned to overlie said thigh supporting shelf.

34. The seating system of claim 1 wherein the fluid is a highly viscous liquid.

35. A seating system primarily intended for use to relieve pressure and to reduce the development of decubitus ulcers, said seating system including:

a tray member having an upper surface and a fluid pad member, said fluid pad member having at least a first pouch partially filled with a fluid having a viscosity of at least one, said pouch being substantially wedge-shaped in cross section with said wedge shape tapering down in vertical thickness from a thicker first end portion to a thinner second end portion, said wedge-shaped pouch having a cover with a bottom portion, a top portion, a base portion, and two side portions, said bottom portion overlying a part of the upper surface of said tray member, said base portion extending upwardly from said bottom portion substantially adjacent said thicker first end portion of said wedge-shaped pouch, said top portion extending from said base portion at said thicker first end portion to the thinner second end portion, said bottom and top portions substantially meeting at said thinner second end portion to form an apex for the wedge shape, and said two side portions being spaced from each other and respectively extending substantially between said bottom and top portions and between said base portion at said thicker first end portion and the apex at said thinner second end portion, said top portion of said cover being oversized and convoluted from the base portion at said thicker first end portion to the apex at said thinner second end portion wherein the linear distance between the base portion and apex is substantially less than the distance therebetween as measured along the convolutions of said top portion of the cover thereby creating slack in said top portion, said base portion also being oversized and convoluted from the bottom portion upwardly to said top portion wherein the linear distance between the bottom and top portions at the thicker first end portion is substantially less than the distance therebetween as measured along the convolutions of said base portion of the cover thereby creating slack in said base portion.

36. The seating system of claim 35 wherein the slack in said base portion as measured by comparing the convoluted distance to the linear distance thereof is greater than the slack in the top portion as measured by comparing the convoluted distance to the linear distance thereof.

37. The seating system of claim 36 wherein the slack in said base portion is at least about 50% greater than the slack in said top portion.

38. The seating system of claim 37 wherein the slack in said base portion is at least about two times as great as the slack in said top portion.

39. The seating system of claim 35 wherein said base portion is also oversized and convoluted between the side portions of said cover wherein the linear distance between the side portions at the thicker first end portion is substantially less than the distance therebetween as measured along the convolutions of said base portion thereby creating additional slack in said base portion.

40. The seating system of claim 39 wherein the additional slack in said base portion as measured by comparing the convoluted distance thereof between the side portions and the linear distance therebetween is substantially less than the vertical slack in said base portion as measured by comparing the convoluted vertical distance to the linear vertical distance thereof.

41. The seating system of claim 40 wherein the vertical slack in the base portion in the vertical direction is at least about two times greater than said additional slack in said base portion.

42. The seating system of claim 39 wherein the additional slack in said base portion as measured by comparing the convoluted distance thereof between the side portions and the linear distance therebetween is less than the slack in the top portion as measured by comparing the convoluted distance to the linear distance thereof, and said slack in said top portion is less than the vertical slack in said base portion as measured by comparing the convoluted vertical distance to the linear vertical distance thereof.

43. The seating system of claim 35 wherein said tray member extends along a central axis and said fluid pad member further includes at least a second, wedge-shaped pouch substantially similar to said first wedge-shaped pouch, said first and second wedge-shaped pouches being positioned on the upper surface of said tray member with the respective base portions of said first and second wedge-shaped pouches abutting one another substantially in a central vertical plane containing the central axis of said tray member.

* * * * *